US007478958B2

(12) United States Patent
Ramet

(10) Patent No.: US 7,478,958 B2
(45) Date of Patent: Jan. 20, 2009

(54) DEVICE FOR APPLICATION OF A LINE

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 592 days.

(21) Appl. No.: 10/821,900

(22) Filed: Apr. 12, 2004

(65) Prior Publication Data

US 2004/0258454 A1 Dec. 23, 2004

Related U.S. Application Data

(60) Provisional application No. 60/470,505, filed on May 15, 2003.

(30) Foreign Application Priority Data

Apr. 11, 2003 (FR) ..... 03 04572

(51) Int. Cl.
*A46B 11/00* (2006.01)

(52) U.S. Cl. ..... 401/124; 401/123

(58) Field of Classification Search ..... 401/118, 401/119, 123–126, 129, 130, 208, 219, 202
See application file for complete search history.

(56) References Cited

U.S. PATENT DOCUMENTS 691,581 A * 1/1902 Baumeister ..... 132/323
1,417,848 A * 5/1922 MacDonald ..... 132/324
1,666,116 A * 4/1928 Bunnell ..... 401/10
2,109,244 A * 2/1938 Zajicek ..... 132/217
2,136,779 A 11/1938 Bednar
3,343,552 A 9/1967 Steffen
3,516,423 A 6/1970 Seidler
3,830,246 A * 8/1974 Gillings ..... 132/321
4,483,356 A 11/1984 Kales
5,010,906 A * 4/1991 Preciutti ..... 132/323
5,927,295 A 7/1999 Quinones
6,508,255 B1 1/2003 Glover et al.

FOREIGN PATENT DOCUMENTS

| | | |
|---|---|---|
| FR | 947341 | 6/1949 |
| FR | 2 065 297 | 7/1971 |
| GB | 317816 | 8/1929 |

* cited by examiner

*Primary Examiner*—Huyen Le
(74) *Attorney, Agent, or Firm*—Oblon, Spivak, McClelland, Maier & Neustadt, P.C.

(57) ABSTRACT

An applicator device includes a grasping element, two arms mounted on the grasping element and an applicator between the two arms. The applicator can apply a product in the form of a line onto a surface. The device can additionally include a reservoir containing the product such that the grasping element incorporates a mechanism to hold the reservoir in a position preventing the applicator from being charged when the latter is applied against the application surface.

60 Claims, 3 Drawing Sheets

DEVICE FOR APPLICATION OF A LINE

CROSS REFERENCE TO RELATED APPLICATIONS

This document claims priority to French Application Number 03 04572, filed Apr. 11, 2003 and U.S. Provisional Application Ser. No. 60/470,505, filed May 15, 2003, the entire contents of which are hereby incorporated by reference.

BACKGROUND OF THE INVENTION

1. Field of the Invention

The present invention relates to devices for the application of a line, for example for applying a line onto a surface using a cosmetic product. The invention can be used in the field of cosmetic applicators such as liners, also termed "eyeliners," used to make a continuous or discontinuous line on the edge of the eyelid. The line applied can emphasize the outline of the eyes, and modify the eyeline and the apparent size of the eyes.

2. Discussion of Background

In known "eyeliners," the applicator, in the form of a point, is mounted at the end of a rod fixed in a cap. This cap is designed to be fitted on a reservoir holding product in a manner such that the applicator is immersed in the product when the cap is in an assembled position on the reservoir. When the user wishes to draw a line along the edge of his/her eyelid, the user has to move the point of the applicator evenly along the surface to be coated. This make-up operation can be difficult to perform without mistakes. The line obtained often includes unwanted deviations.

U.S. Pat. No. 3,343,552 describes the use of an applicator preformed so as to be perfectly adapted to the surface to which it is to be applied. The eye makeup procedure taught by this document is not adaptable. Given that the applicator is preformed to match the external outline of an average eyelid, it is not suitable for all users.

U.S. Pat. No. 3,516,423 describes cosmetic applicators used to apply false-eyelashes onto the edge of an eyelid. Such an applicator includes two arms arranged in the manner of scissors such that a carrier element is disposed between the ends of the two arms. The carrier element is adhesive and capable of holding the false lashes. Depending on the separation of the two arms, the carrier adopts a more or less concave shape to adapt to the more or less convex shape of the user's eyelids. Manipulation of such an applicator requires that the two arms be kept a specific distance apart to maintain the curvature of the carrier. This type of applicator poses a drawback in that it obliges the user to contract her hands and to hold this contracted position during application of the false lashes. Moreover, in cases where the applicator is held in a convex shape, the false eyelash is then more difficult to detach from its adhesive carrier.

Document U.S. Pat. No. 6,508,255 describes cosmetic applicators capable of transferring a quantity of product available on an applicator to a surface to be coated, and notably onto an eyelid, the applicator extending between two arms carried by a handle.

SUMMARY OF THE INVENTION

There is a need to provide a packaging and applicator device of simple design enabling convenient and repeatable application of a fluid product directly in the form of a line. To this end, a preferred embodiment of the invention includes an applicator, preferably flexible and of elongated shape extending between two points, these two points being preferably located at the end of two arms mounted on a handle of the device. The device can also include a reservoir of product capable of recharging the applicator, for example between two uses. Preferably, the flexibility of the arms combined with pliability of the applicator enables the product to be applied in a convenient manner while needing to grasp the handle with only one hand.

Furthermore, the makeup actions associated with a device according to a preferred embodiment of the invention can confer greater visibility, in that the handle can be held and oriented parallel to an axis on which the applicator is brought into proximity with the area to be coated.

Preferably, the user applies a first end of the applicator, located in proximity to a point of attachment of this applicator to one end of the arm, onto the skin at a desired starting point for the line. The applicator is then brought down so as to progressively apply the line onto the skin. In the case where the surface to be coated is curved, the applicator can be flexible. Furthermore, the length of the applicator can be adapted by making it elastically deformable. The user thus applies a line between the two ends of the arms, or a portion of the line only, onto the skin. The flexibility of the arms also confers a degree of softness to the application, the pressure exerted on the surface to be coated being thereby diminished.

In a preferred embodiment, the invention includes a packaging and applicator device for the application to a surface to be coated, notably an eyelid, of a cosmetic or beauty care formulation. The device can include a grasping element, two arms mounted on the grasping element and an applicator capable of applying this formulation onto the surface to be coated. The applicator is held between the two arms. At least one of the two arms and/or a junction between the two arms and the grasping element can be at least partially elastically deformable.

In a variant, the assembly of the arms on the grasping element can be disassembled. The arms are then detachable from the grasping element.

In another embodiment, the packaging includes a reservoir containing the product and capable of charging the applicator. The grasping element incorporates a connection to the reservoir in a position preventing the applicator from being charged when the latter is applied against the application surface.

For example, an opening in the reservoir can be concealed in a cavity of the grasping element capable of receiving the reservoir. In a variant, the applicator is mounted on the reservoir so that even though it is connected to the grasping element, it cannot be applied onto a surface to be coated until the reservoir is detached from the grasping element and from the applicator.

The cosmetic product applied using the device according to a preferred embodiment of the invention is preferably fluid, and more particularly liquid or semi-liquid. Within the meaning of the cosmetics directive 76/768/CEE, a cosmetic product is defined as any substance or preparation intended to be placed in contact with various superficial parts of the human body (e.g., skin, hair, nails, lips) for the exclusive or principal purpose of cleansing, perfuming, modifying the appearance, protecting or conditioning these surfaces. In particular, this product can be an eyeliner used to emphasize the edge of the eyelids.

Advantageously, the applicator can be elastically deformable. The applicator includes a portion intended to be applied against a surface to be coated. Preferably, in the relaxed position, this portion extends in a direction parallel to an axis passing through both ends of the arms. Preferably, this portion of the applicator is coated directly with the product.

Advantageously, one of the two and possibly both arms can be elastically deformable. More advantageously, the grasping element can include an elastically deformable mechanism in the vicinity of a junction with the two arms. Preferably, this junction is more elastically deformable than a stiffer part of the grasping element.

The arms can form an arc. They support the applicator between two free ends of this arc. The arc formed is, for example, an arc of a circle, an arc of an oval, or an arc of an ellipse. In a variant, the arms can also be arranged so as to form a V or a U, or any other configuration enabling an end of each of these arms to be presented in a prominent manner relative to the grasping element on which they are fixed. A first arm includes a first free end, and a second arm includes a second free end. The applicator is, for example, suspended between this first free end and the second free end.

In a variant, both arms are contiguous and form a single component in the shape of an arc such that the two free ends of the arc correspond respectively to the first free end and the second free end.

In another variant, the applicator is held by pivots articulated at the free ends of the arms. These pivots are each articulated, for example, about a pivoting axis orthogonal to a principal lengthwise axis of the grasping element. These joints can be pivots, or more generally ball joints. In a variant, the pivots can include slides in which the applicator is able to slide.

Preferably, the applicator includes a filament portion intended to be applied against a surface to be coated in a direction orthogonal to an axis of the grasping element.

In a preferred embodiment, the reservoir can incorporate a slot for the insertion of at least the applicator. When inserted into this slot, the applicator is capable of being charged with a quantity of product. For example, the product contained in the reservoir is impregnated in a pad. The pad is, for example, a U-shaped piece of foam wherein the mouth of the U is opposite the slot to receive the applicator. Preferably, the foam is of the open-cell type. In a variant, the pad can be made of felt.

For example, to ensure that the applicator is retained in such a slot, the slot can have a length shorter than the relaxed distance between the two furthest apart free ends of the two arms. Thus, in the case where the arms are flexible, they can be elastically deformable to facilitate insertion or withdrawal of the applicator from the slot. In another variant wherein the arms are not flexible, it is the slot that is elastically deformable in this case to allow insertion or withdrawal of the applicator.

Advantageously, the grasping element can be detachable from the two arms. It is notably useful to detach the grasping element when the applicator is disposed in the slot of the reservoir. In this position, provision can be made to retain the grasping element finally detached from the reservoir. For this purpose, the grasping element can incorporate a screw thread to engage with a threaded wall of the reservoir. In a variant, the grasping element can be retained on the reservoir by a snap-on or clip attachment.

Preferably, the grasping element includes a resilient retention mechanism to facilitate attachment in a reversible manner on the two arms.

In an advantageous embodiment of the invention, the two arms can be mounted integrally and rotatably on the grasping element about a fixed axis of rotation. The axis of rotation can form a non-zero angle, for example, in the order of 45°, with a principal lengthwise axis of the grasping element. The axis of rotation and the principal lengthwise axis can be secant or non-secant at the level of a junction between the two arms and the grasping element. In this variant, by rotating the two arms relative to the grasping element, the user can modify the angle formed between the principal lengthwise axis and a plane passing through the two arms.

The invention can be used to apply makeup using different actions according to the effect sought, or to modify the angle of attack of the applicator during application. Preferably, the grasping element has an inclined surface relative to the principal lengthwise axis, and against which a counterpart surface of the two arms bears, the axis of rotation being orthogonal to this inclined surface. In particular, the two arms can extend in a plane orthogonal to this counterpart surface.

To facilitate rotation, the two arms and the grasping element can be assembled in various ways, notably by a snap-on attachment, hot or cold snap-riveting, riveting, or shrinking. For example, at least one of the two arms and the grasping element can incorporate a pivot engaged in a seating of the other of the two arms and the grasping element to form the axis of rotation. This pivot can be mounted by snap-on attachment, snap-riveting, riveting or shrinking into the seating.

The grasping element can be made, for example, with the aforementioned pivot, which can project beyond the inclined surface described above. This pivot can be made in several parts and notably can be split or non-split. This pivot can be provided with a resilient indentation at one end in order to snap into the seating.

Advantageously, in a particular embodiment, the two arms and the grasping element can cooperate so as to enable a user to immobilize the two arms in at least one predefined position relative to the grasping element, and preferably in at least two, or three predefined positions.

For example, at least one projection can be made on at least one of the surfaces at the grasping element and the two arms to enable a user to more readily immobilize the grasping element in a predefined angular position relative to the two arms.

For example, a first position of the two arms can be such that they extend in a plane parallel to the principal lengthwise axis of the grasping element. This first position can, for example, be observed in an at-rest position, and/or after rotating the two arms through 180° relative to this at-rest position.

As a variant, a second position of the two arms can be such that they extend in a plane forming a non-zero angle, for example, in the order of 45°, with the principal lengthwise axis of the grasping element. This second position can be obtained after rotating through 90° relative to the first position.

In a particular embodiment of the invention, the grasping element can also serve as a closure capsule for the reservoir, being arranged, for example, to be fixed by a snap-on attachment, onto an opening of the reservoir.

Advantageously, the device can include a cap capable of being retained on the grasping element so that the applicator and possibly the two arms are concealed in the cap. In particular, the reservoir can be integral with the cap. Then, with the cap in the mounted position on the grasping element, a dispensing aperture in the reservoir can emerge at an outer circumference of the cap or in a recess in the cap receiving the applicator.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
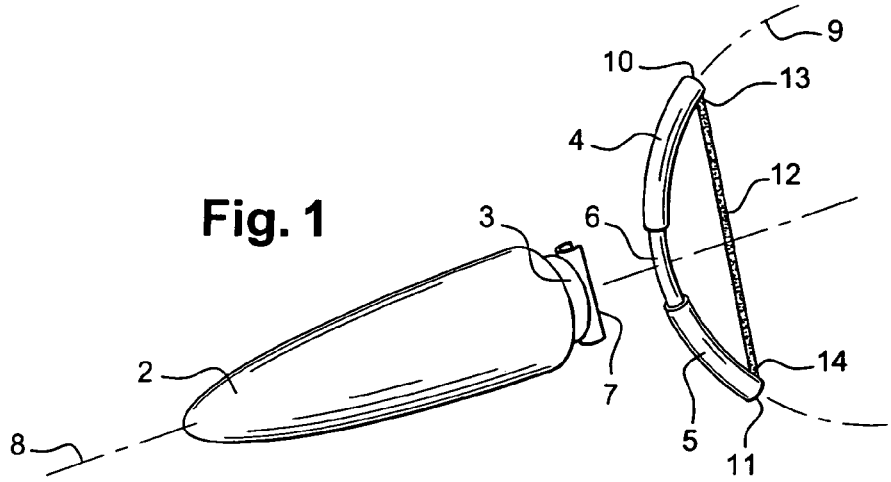
FIG. 1 is an exploded view of a device according to a particular embodiment of the invention.

FIG. 1 shows an applicator device 1 according to a preferred embodiment of the invention. The device 1 includes a grasping element 2, also termed the handle 2 in the following description, at one end 3 of which are disposed two arms, preferably flexible, respectively 4 and 5. The arms 4 and 5 are assembled one to the other in proximity to a grasping zone 6 connected to the end 3 of the handle 2. The grasping element 2 has a principal lengthwise axis 8. The arms 4 and 5 carry an applicator 12.

In the variant shown in FIG. 1, the handle 2 is detachable from the arms 4 and 5. The handle 2 includes a retention mechanism 7 at its end 3 designed to cooperate with the grasping zone 6. Preferably, this retention mechanism 7 is resilient so as to be attachable and/or detachable from arms 4 and 5 in a reversible manner. In a reciprocal manner, the end 3 can include an engagement mechanism with a retention mechanism presented by the zone 6. For example, the end 3 defined on the grasping element 2 at a junction with this grasping zone 6 can be elastically deformable. The end 3 then can incorporate a spring, for example.

For example, it can be useful to detach an assembly formed by the arms 4 and 5 and the applicator 12 from the grasping element 2 to allow the applicator 12 to be changed, in particular when it is worn. The worn assembly can then be discarded, for example. A replacement unit including two arms such as 4 and 5 and an applicator such as 12 held between the two arms can then be fitted to the bare grasping element 2. Preferably, these units can be different so as to offer different arm positions or different types of applicators. In effect, the structure of the applicator 12 contributes to the shape of the line which will then be reproduced. For example, a box containing several such replacement units can include applicators of different thicknesses to enable more or less fine lines to be applied. As a variant, these replacement units can be used to avoid coating the applicator with different products, and notably of different colors.

According to the particular embodiments shown in FIGS. 4 to 7 and 10, the grasping element 2 includes a pivot 30 engaged in a counterpart seating 31 in the grasping zone 6 of the two arms 4 and 5. The pivot 30 is disposed orthogonally to an axis of the pivot 34 relative to a surface 32 of the grasping element 2. The counterpart seating 31 emerges at a surface 33 of the grasping zone 6. The surfaces 32 and 33 are counterpart with respect to each other so that they mate together when the pivot 30 is engaged in the seating 31, and so as to allow rotation around the pivot. For example, the surfaces 32 and 33 are flat. As a variant, the surfaces 32 and 33 are respectively dome shaped, one being concave and the other convex. For example, this dome can correspond to a hemisphere.

Preferably, the two arms 4 and 5 are fixed relative to the grasping zone 6 so as to allow the orientation of the two arms to be modified relative to the grasping element 2. In effect, the surfaces 32 and 33 form an angle different from 90° with the principal lengthwise axis 8. Thus, depending on the rotation applied to the two arms, their position relative to the grasping element 2 is modified. The two arms do not necessarily extend in one plane, but they are configured so that a plane passing through the applicator 12 and the grasping zone 6 can intersect with the principal lengthwise axis 8 in at least one angular position of the two arms 4 and 5 relative to the grasping element 2.

Thus, according to a particular embodiment of the present invention, the grasping element 2 has a longitudinal axis 8 and an end surface 32 at an end 3, the end surface 32 having a tangent making an angle with the longitudinal axis other than 90°. The applicator portion of the system includes two arms 4,5 linked to each other via the connection portion 31 detachably connected to the end 3 of the grasping element 2. The connection portion 31 has a connection surface 33 corresponding to the end surface 32 of the grasping element 2.

Figure 4:
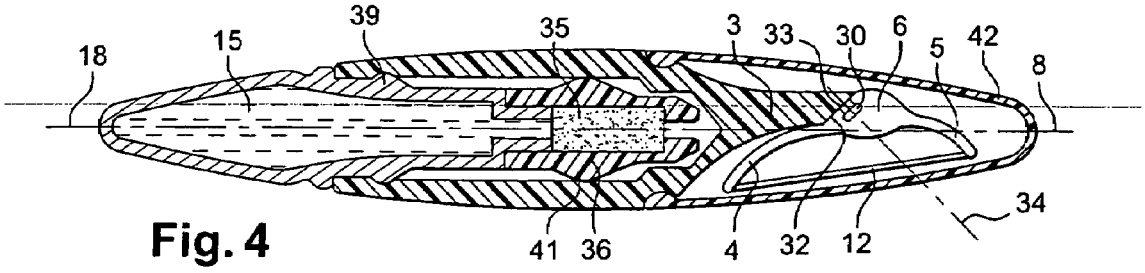
FIG. 4 is a sectional view of an alternative embodiment of a device according to the invention.

In FIG. 4, the two arms 4 and 5 are in a first position disposed in a plane passing through the lengthwise axis 8 and the pivot axis 34. Preferably, the surfaces 32 and 33 at which the rotation takes place are slightly eccentric relative to the principal lengthwise axis 8. In particular, the principal lengthwise axis 8 and the pivot axis 34 intersect at some distance from surfaces 32 and 33. By virtue of this, notably insofar as the two arms are not symmetrical one to the other, and in particular in the case where arm 5 is shorter than arm 4, this first position then corresponds to a minimum size position in that only the shorter arm 5 projects beyond the grasping element 2 substantially along the axis 8.

Figure 5:
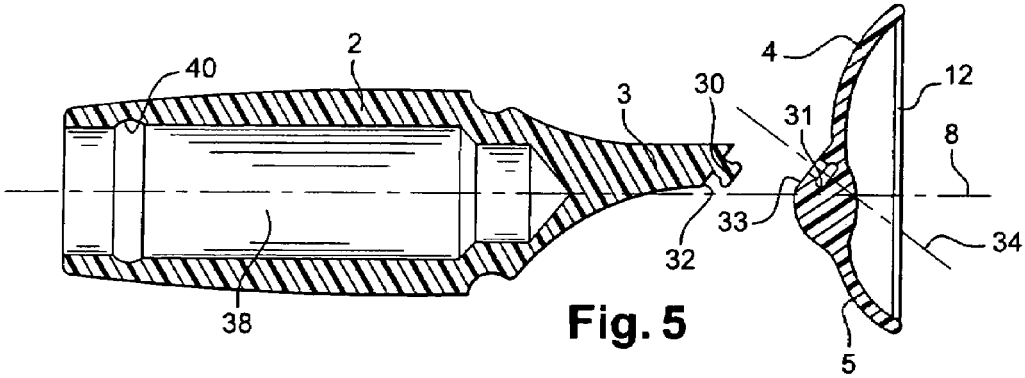
FIG. 5 is an exploded view of a grasping element fitted with two arms according to an alternative embodiment of a device according to the invention.

In FIG. 5, the two arms have been rotated through 180° relative to the position in FIG. 4 and are in a second position while remaining in the plane passing through the lengthwise axis 8 and the pivot axis 34. This second position is different from the first position in the case where the two arms are different from each other. In particular, in this second position, the longer arm 4 projects beyond the grasping element 2. In this case, the arms are configured so that in the first position the applicator 12 extends substantially parallel to lengthwise axis 8, whereas in the second position it extends substantially orthogonally to the lengthwise axis 8.

Figure 6:
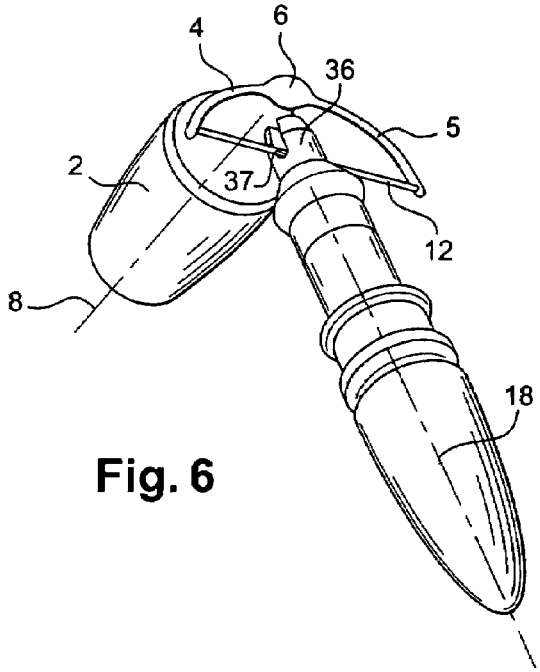
FIG. 6 is a perspective view of an alternative embodiment of a device according to the invention during charging of the applicator.
Figure 7:
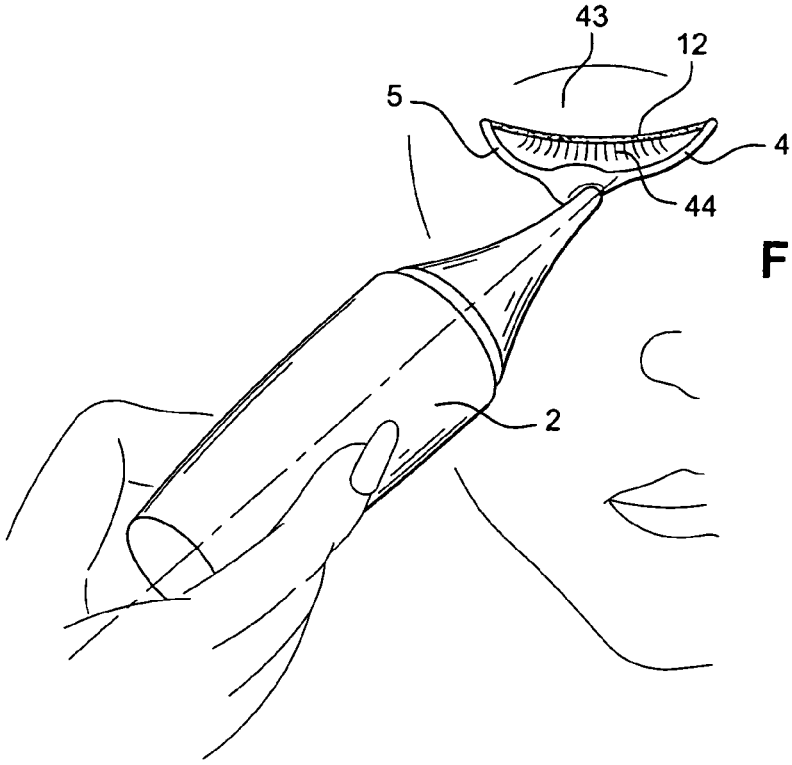
FIG. 7 is a perspective view of an alternative embodiment of a device according to the invention during application of the applicator to an eyelid.

In a third position, illustrated in FIG. 6, the two arms extend substantially in a plane secant with the plane passing through the lengthwise axis 8 and the pivot axis 34. In this third position, these two planes can be orthogonal. This third position can be obtained by rotation through 90° relative to either the first or second positions.

Figure 10:
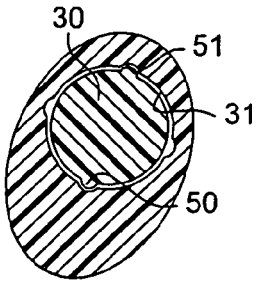
FIG. 10 is a transverse cross-sectional view of a junction between two arms and a grasping element according to a particular embodiment of a device according to the invention.

Preferably, as illustrated in FIG. 10, the pivot 30 includes at least one spline 50 capable of engaging with at least three grooves such as 51 formed on the inner circumference of the seating 31. The spline 50 is counterpart to the grooves such as 51 so as to index between at least the three positions referred to above. For example, the pivot 30 includes two diametrically opposite splines 50 designed to engage with four grooves 51, the grooves 51 being evenly spaced on the inner circumference of the seating 31. As a variant, a projection is provided on one of the surfaces 32 or 33 to engage with counterpart recesses provided on the other surface 32 or 33.

In another variant, not shown, the grasping element 2 is molded in a single piece with the arms 4 and 5. In this case, it is molded in a thermoplastic material that is at least slightly flexible.

The arms 4 and 5 are arc shaped. The grasping element 2 is mounted at an outer circumference of this arc. Preferably, according to the examples in FIGS. 1 to 3, the two arms are symmetrical with each other relative to an axis intersecting the grasping zone 6 and extending along the principal lengthwise axis 8 of the handle 2. In the examples illustrated in FIGS. 1 to 3, the two arms are also symmetrical with each other relative to a plane passing through this lengthwise axis 8.

The arms 4 and 5 present an overall curvature 9 such that the axis 8 is orthogonal to a tangent of this curve. The first arm 4 includes a first free end 10, and the second arm 5 includes a second free end 11. In particular, they form an arc of a circle, and the ends 10 and 11 can be diametrically opposite.

The applicator 12 is held between these two ends 10 and 11. This applicator 12 is preferably elongated and forms a flexible strip, for example, held respectively by two pivots 13 and 14 on each of the ends 10 and 11. These pivots 13 and 14 can, for example, pivot on axes respectively orthogonal to the lengthwise axis 8.

Preferably, in proximity to at least one of the ends of the applicator 12, the applicator 12 can incorporate a boss composed of a protuberant element which can be felt during application, and therefore forming a tactile element to assist the positioning of a first point of the applicator 12 relative to the surface to be coated.

In a variant, the applicator 12 is suspended between the two ends 10 and 11, not fitted with pivots, but each only having a mechanism to hold one extremity of the applicator 12. For example, the ends 10 and 11 can be provided with slots in which the strip formed by the applicator 12 can be held.

Schematically, the assembly 1 can resemble an archer's bow, the flexible arms corresponding to the bow and the applicator corresponding to the bowstring.

The applicator 12 can be elastically deformable. In this case also, it is not absolutely necessary to provide pivot joints such as 13 and 14. The length of this applicator 12 is then modifiable to adapt to the length of line desired. As a variant, the arms 4 and 5 can also be elastically deformable.

To apply a line using the device 1, the user can hold the grasping element 2 in one hand, and can place one of the ends 10 or 11 in proximity to a starting point for the line to be applied. The user then rotates the device around this first end bearing against the surface to be coated, forming a pivot. The applicator 12 can thus be progressively placed in contact with the surface to be coated. Given the elongated shape of the applicator 12, a line of more or less constant thickness can be obtained. Furthermore, given the pliability of the applicator 12, and the flexibility conferred by the flexible arms 4 and 5 and possibly by the pivots 13 and 14, the device 1 can come into contact with a curved surface to be coated. Notably, it is adapted to suit the morphology of an eyelid that is generally convex.

Preferably, the first end 10, or respectively 11, can be placed in proximity to an inner corner of the eyelid, and the hand can be moved towards the eyelid so as to position the second end 11, or respectively 10, in proximity to an outer corner of the eyelid. Conversely, and notably in the case where it is not desired to cover the entire edge of the eyelid with such a line, one of the ends can be first placed in proximity to the outer corner of the eye and the hand can be turned so as to form the line progressively, stopping before the inner corner of the eye is reached.

Applicator devices according to the invention can thus permit fine and precise application of a continuous line. The application can be performed with one hand without the use of a mirror to monitor the application. In effect, the actions associated with the device according to the invention can enable the outline of an eyelid to be coated with certainty over a defined length while keeping the starting point of the line under control. The application can be performed under conditions where the user is subjected to shaking, for example, in a vehicle, in that the application can be effected while maintaining a continuous fixed point of support on the eyelid.

Figure 2:
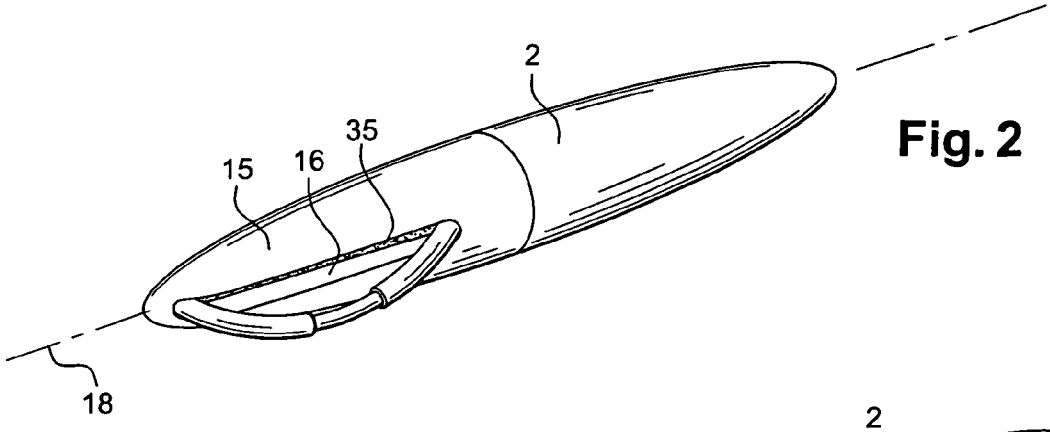
FIG. 2 is an assembled view of a device according to a particular embodiment of the invention.
Figure 3:
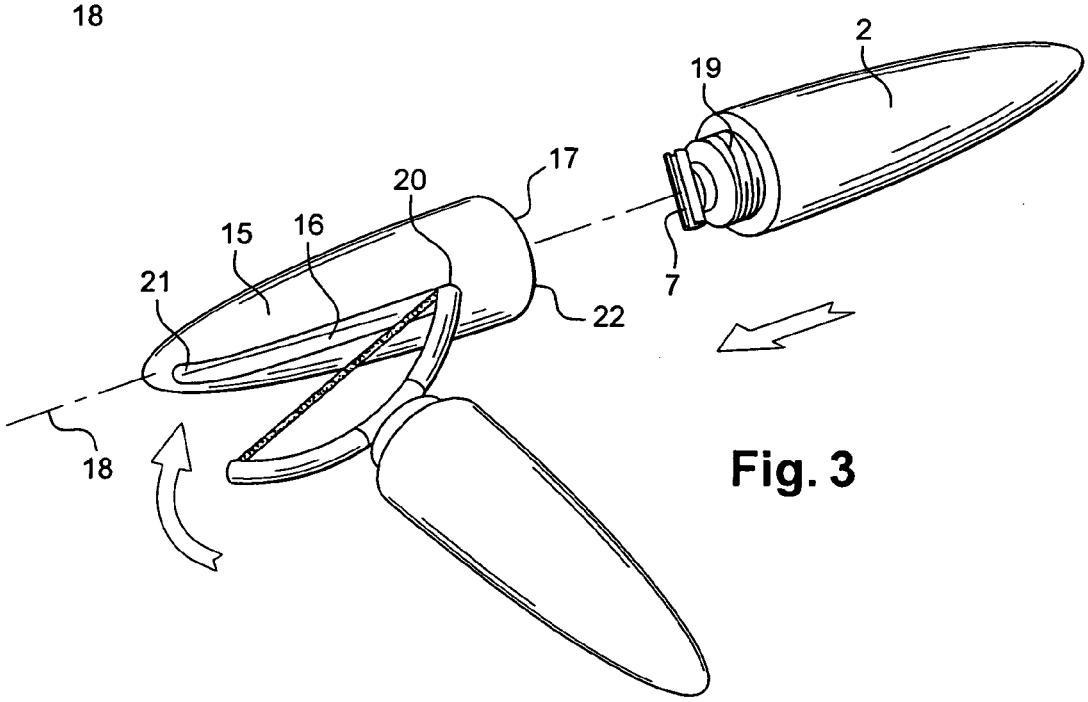
FIG. 3 is a sectional assembly view of the device according to FIG. 2.

The applicator 12 is preferably first coated with product to be applied by a charging pad 35. This charging pad 35 is, for example, placed in communication with a reservoir 15. The charging pad 35 is, for example, U-shaped, as shown in FIGS. 2 and 3, such that the mouth of the U is presented opposite a slot 16 in the reservoir 15. The charging pad 35 is, for example, made from open-cell foam impregnated with the product contained in the reservoir 15 by capillary action. As a variant, the reservoir 15 is fitted with a stick or a piston or deformable walls so as to be able to compress the product towards the charging pad 35.

In FIGS. 2 and 3, the applicator 12 can be inserted into the slot 16. In particular, the reservoir 15 is designed to be capable of holding the applicator 12. In the case where the grasping element 2 is detachable, only the applicator 12 and a portion of the flexible arms 4 and 5 are inserted in the slot 16. The reservoir can also include other retaining mechanism 17 to hold the grasping element 2 on the reservoir. The reservoir 15 has, for example, an elongated shape, the slot 16 being formed along a principal lengthwise axis 18 of the reservoir 15. In this example, the grasping element 2 is mounted on the reservoir 15, so that its principal lengthwise axis 8 is superimposed on the axis 18.

Notably, the end 3 of the handle 2 incorporates counterpart mechanism 19 to engage with the retaining mechanism 17 on the reservoir 15. The reservoir 15 then incorporates a seating of which an opening 22 is defined orthogonally to the axis 18, and such that the retaining mechanism 7 on the end 3 can be inserted therein. In particular, the seating has a groove on an inner wall designed to engage with a threaded circumference presented by the counterpart mechanism 19. The handle 2 has thus a first coupling mechanism 7 and a second coupling mechanism 19. The applicator can be detachably coupled to the first coupling mechanism 7 in a first position (FIGS. 1 and 3), and the reservoir 15 can be detachably coupled to the second coupling mechanism 19 in a second position (FIG. 2). The reservoir 15 is not coupled to the second coupling mechanism 19 in the first position since the applicator is coupled to the handle 2 in this position. Similarly, the applicator is not coupled to the first coupling mechanism 7 in the second position since the reservoir 15 is coupled to the handle 2 in this position. As seen in FIGS. 2-3, the longitudinal axis 18 of the handle 2 is collinear with the longitudinal axis of the reservoir in the second position. The first coupling mechanism 7 is positioned on the longitudinal axis 18 of the handle 2, while the second coupling mechanism 19 is offset from the longitudinal axis 18.

To hold the applicator 12 in the slot 16, this slot 16 has a length relative to the axis 18 that is shorter than the distance between the two ends 10 and 11 of the two flexible arms, i.e. shorter than a relaxed length of the applicator 12.

In this particular embodiment, to facilitate insertion of the applicator 12 into the slot 16, it may be necessary to apply pressure to the arms 4 and 5, which are flexible in this case, so as to bring their ends 10 and 11 closer together. For this purpose, one end 10 or 11 is preferably brought to bear against a corner 20 of the slot 16, and a rotational movement is then made about this corner 20 forming a pivot, at the same time squeezing the flexible arm not engaged in the slot 16 towards the other arm. When the other end 11 or 10 is lowered towards the slot 16, it can be inserted without difficulty. Once the applicator 12 is fully inserted into the slot 16, the pressure exerted on the corner 20 is relaxed. The other end 11 or 10 then bears against a second corner 21 opposite the corner 20. The distance between the corners 20 and 21 is such that the applicator 12 cannot leave the slot unless pressure is again applied towards one of the corners 20 or 21 and the applicator is then rotated about a pivot formed by this corner.

Once the applicator 12 is held in the slot 16, the grasping element 2 can be detached from the grasping zone 6 which preferably remains outside the slot 16. The grasping element 2 is then mounted on the reservoir 15 as indicated above.

As a variant, illustrated in FIGS. 4 and 6, the charging pad 35 is placed in proximity to a neck 36 of the reservoir 15. The charging pad 35 in this case closes off the neck such that it is in permanent fluid communication with the inside of the reservoir 15 and with the product contained therein. The pad 35 can be permanently impregnated with product. The width of neck 36 in this case can be considerably smaller than the length of the applicator 12 to be coated. Preferably, the neck 36 can incorporate two diametrically opposite slots such as 37 to allow the applicator 12 to slide between these two slots. The full length of the applicator 12 can be made to slide between the two slots such as 37. Preferably, the charging pad 35 is arranged so as to be pressed against the applicator 12 when the latter is inserted to its fullest extent into the mouth of the slots such as 37.

Figure 8:
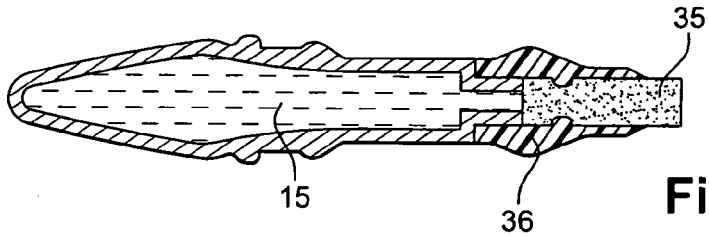
FIG. 8 is a sectional view of a particular embodiment of the reservoir of a device according to the invention.

As a variant, illustrated in FIG. 8, the charging pad 35 projects beyond the neck 36, the pad 35 being in fluid communication with the inside of the reservoir 15 and with the product contained therein. The pad 35 in this case has an annular groove designed to engage with an annular lip projecting radially on an inner circumference of the neck 36 so as to be retained thereon. The pad 35 can also in this case be lightly squeezed or lightly pressed into the neck 36 when it is applied against the applicator 12.

Figure 9:
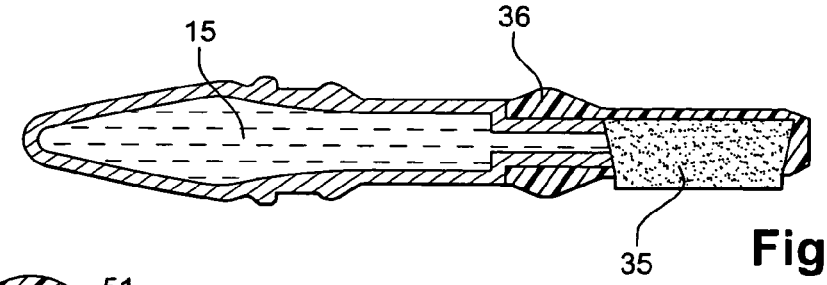
FIG. 9 is a sectional view of another embodiment of the reservoir of a device according to the invention.

In another variant, illustrated in FIG. 9, to avoid having to draw the pad 35 over the full length of the applicator 12, the pad can have a length substantially identical to that of applicator 12. In addition, to avoid having to move the applicator 12 in a slot such as 16 or 37, the neck 36 not necessarily being widened for this purpose, the pad 35 is then preferably present on the outer lateral circumference of the neck 36. The neck 36 then incorporates a lateral window beyond which the pad 35 extends, this window emerging into a cavity of trapezoidal cross-section configured to hold the pad 35. The pad 35 can then be force fitted into the cavity. In this variant also, the pad 35 remains in fluid communication with the inside of the reservoir 15. The length of this external lateral circumference along the lengthwise axis 18 of the reservoir 15 can be substantially equal to the length of the applicator 12.

In the examples illustrated in FIGS. 4 to 9, the reservoir 15 is designed to be fixed in a cavity 38 in the grasping element 2. Preferably, the neck 36 complete with charging pad 35 is placed in this cavity 38. The grasping element 2 then serves as a closure capsule for the reservoir 15. The reservoir 15 is inserted into a rear part of the grasping element 2 opposite the end 3 at which the arms 4 and 5 are attached. For example, the reservoir 15 has on its outer circumference retention mechanism 39 capable of engaging with counterpart mechanism 40 presented on the inner circumference of the cavity 38. For example, the retaining mechanism 39 can be an annular collar capable of snapping into an annular groove 40 on the inner circumference of the cavity 38.

Preferably, the outer circumference of the neck 36 also includes an annular ring 41 capable of bearing on the inner circumference of the cavity 38 so as to provide a leaktight joint. In this case, the reservoir 15 is mounted in a leaktight manner inside the cavity 38.

A preferred use of such a device 1 involves removing the cap 42 fitted on the grasping element 2, the cap 42 serving to conceal the two arms 4 and 5 and the applicator 12, notably when they are in the first position. The cap 42 can also serve to hold the applicator 12 in a constant humidity environment. For example, the cap 42 incorporates a humidifier to prevent drying out of the applicator 12.

The user then detaches the reservoir 15 from the cavity 38, and then coats the applicator 12 using the charging pad 35, as shown for example in FIG. 6. The user then applies the applicator 12 coated with product to an eyelid 43, as shown for example in FIG. 7, notably in proximity to the base of the eyelashes 44.

Preferably, before the applicator 12 is applied to the eyelid, the user can replace the reservoir 15 in the grasping element 2, the grasping element 2 being thus weighted by the reservoir 15. It is therefore more pleasant to handle.

As a variant, not shown, a cap such as 42 includes a second reservoir forming a product reserve, for example, a product different from that contained in the reservoir 15. This second reservoir is, for example, presented at an inner circumference of the cap 42, and in this case, with the device in a closed position, the applicator 12 is maintained in contact with the product reserve. Alternatively, the second reservoir can be accessible only from the outer circumference of the cap 42. And in this case, the cap must first be detached from the grasping element 2 to allow the applicator 12 to be coated with product from this second reservoir.

Throughout the description, including the claims, the expression "comprising a" should be understood to be synonymous with "comprising at least one", unless otherwise specified.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for applying a product to a surface comprising:

a grasping element;

two arms mounted on the grasping element via a junction;

an applicator which is coupled to both of the two arms and which extends between the two arms; and a reservoir containing a cosmetic makeup product to be charged on the applicator and applied to the surface;

wherein at least one of the two arms or said junction is at least partially elastically deformable and wherein said reservoir is at least partially concealed in a cavity within said device, and wherein the grasping element is detachable from the two arms.

2. The device according to claim 1, wherein the applicator is at least partially elastically deformable.

3. The device according to claim 1, wherein at least one of the two arms is at least partially elastically deformable.

4. The device according to claim 1, wherein the grasping element is elastically deformable in proximity to said junction.

5. The device according to claim 1, wherein each of said two arms has a free end, and said two arms form an arc and support the applicator between the two free ends.

6. The device according to claim 1, wherein the applicator includes a filament portion applicable against said surface in a direction orthogonal to a principal lengthwise axis of the grasping element.

7. The device according to claim 1, wherein the applicator is mounted so as to pivot about pivoting axes orthogonal to a principal lengthwise axis of the grasping element at free ends of the arms.

8. The device according to claim 1, wherein said surface is an eyelid.

9. The device according claim 1, wherein the two arms are held by a resilient retaining mechanism on the grasping element.

10. The device according to claim 1, wherein the grasping element connects to the reservoir in a position preventing the applicator from being charged when the applicator is applied against the surface.

11. A device according to claim 1, wherein the grasping element is detachably connected to the reservoir and wherein when the reservoir is connected to the grasping element the reservoir is in a position preventing the applicator from being charged when the applicator is applied against the surface; and wherein the two arms are held by a resilient retaining mechanism on the grasping element.

12. A device according to claim 1, wherein the reservoir is detachably coupled to said grasping element.

13. A device for applying a product to a surface comprising:

a grasping element;

two arms mounted on the grasping element via a junction; and an applicator between the two arms;

wherein at least one of the two arms or said junction is at least partially elastically deformable;

wherein the two arms are mounted integrally and rotatably on the grasping element about a fixed axis of rotation, the axis of rotation forming a non-zero angle with a principal lengthwise axis of the grasping element, and wherein in a first position the two arms extend in a plane parallel to the principal lengthwise axis of the grasping element; and wherein at least one of the two arms and the grasping element incorporates a pivot engaged in a seating to form the axis of rotation;

wherein the pivot includes a resilient indentation capable of snapping into the seating.

14. The device according to claim 13, wherein said angle is about 45°.

15. The device according to claim 13, wherein the two arms and the grasping element cooperate so as to enable an immobilization of the two arms in at least one predefined position relative to the grasping element.

16. The device according to claim 13, wherein the two arms and the grasping element cooperate so as to enable an immobilization of the two arms in at least two predefined positions.

17. The device according to claim 13, wherein in a second position, the two arms extend in a plane having a non-zero angle with the principal lengthwise axis of the grasping element.

18. A device for applying a product to a surface comprising:

a grasping element;

two arms mounted on the grasping element via a junction; and an applicator between the two arms;

wherein at least one of the two arms or said junction is at least partially elastically deformable; and wherein the two arms are mounted integrally and rotatably on the grasping element about a fixed axis of rotation, the axis of rotation forming a non-zero angle with a principal lengthwise axis of the grasping element, and wherein the grasping element has an inclined surface relative to the principal lengthwise axis, and against which a counterpart surface of the two arms bears, the axis of rotation being orthogonal to said inclined surface.

19. The device according to claim 18, wherein the two arms extend in a plane orthogonal to the counterpart surface.

20. The device according to claim 18, further comprising at least one projection on at least one of the surfaces of the grasping element and the two arms, said projection enabling an immobilization of the two arms in a predefined angular position relative to the grasping element.

21. A device according to claim 18, further comprising:

a reservoir capable of charging the applicator with the product, and wherein the grasping element connects to the reservoir in a position preventing the applicator from being charged when the applicator is applied against the surface, and wherein said surface is an eyelid.

22. A device for applying a cosmetic makeup product to a surface comprising:

a grasping element;

two arms mounted on the grasping element via a junction;

an applicator which is coupled to both of the two arms and which extends between the two arms; and a reservoir at least partially concealed within the device, said reservoir containing a cosmetic makeup product and capable of charging the applicator with the cosmetic makeup product, wherein the grasping element connects to the reservoir in a position preventing the applicator from being charged when the applicator is applied against the surface, wherein said arms and reservoir are relatively movable to place the applicator in contact with the cosmetic makeup product in said reservoir for said cosmetic makeup product to be charged on said applicator when the cosmetic makeup product is not being applied against the surface, wherein the applicator includes a filament portion applicable against said surface in a direction orthogonal to a principal lengthwise axis of the grasping element; and wherein the device further comprises a pad impregnated with the cosmetic make-up product.

23. The device according to claim 22, wherein the applicator is at least partially elastically deformable.

24. The device according to claim 22, wherein at least one of the two arms is at least partially elastically deformable.

25. The device according to claim 22, wherein the grasping element is elastically deformable in proximity to said junction.

26. The device according to claim 22, wherein each of said two arms has a free end, and said two arms form an arc and support the applicator between the two free ends.

27. The device according to claim 22, wherein the applicator is mounted so as to pivot about pivoting axes orthogonal to a principal lengthwise axis of the grasping element at free ends of the arms.

28. The device according to claim 22, wherein the grasping element serves as a closure capsule for the reservoir.

29. The device according to claim 22, wherein the grasping element facilitates attachment to the reservoir.

30. The device according to claim 22, further comprising a cap mountable on said grasping element, wherein said reservoir is provided in said cap and wherein a dispensing aperture of the reservoir emerges at an outer circumference of said cap.

31. The device according to claim 22, further comprising a cap mountable on said grasping element, wherein said reservoir is provided in said cap, and wherein a dispensing aperture of the reservoir emerges in a recess in the cap which receives the applicator.

32. The device according to claim 22, wherein the reservoir incorporates a slot for the insertion of at least the applicator.

33. The device according to claim 32, wherein the slot is elastically deformable to allow forcible insertion and withdrawal of the applicator from the slot.

34. The device according to claim 32, wherein the arms are elastically deformable to allow forcible insertion and withdrawal of the applicator from the slot.

35. A device according to claim 22, wherein the reservoir is detachably coupled to said grasping element.

36. A device for applying a cosmetic makeup product to a surface comprising:

a grasping element;

two arms mounted on the grasping element via a junction;

an applicator which is coupled to both of the two arms and which extends between the two arms; and a reservoir at least partially concealed within the device, said reservoir containing a cosmetic makeup product and capable of charging the applicator with the cosmetic makeup product, wherein the grasping element connects to the reservoir in a position preventing the applicator from being charged when the applicator is applied against the surface, and wherein said arms and reservoir are relatively movable to place the applicator in contact with the cosmetic makeup product in said reservoir for said cosmetic makeup product to be charged on said applicator when the cosmetic makeup product is not being applied against the surfaced, and wherein the grasping element is detachable from the two arms.

37. A device for applying a product to a surface comprising:

a grasping element;

two arms mounted on the grasping element via a junction;

an applicator between the two arms; and a reservoir capable of charging the applicator with the product;

wherein the grasping element connects to the reservoir in a position preventing the applicator from being charged when the applicator is applied against the surface; and wherein the two arms are mounted integrally and rotatably on the grasping element about a fixed axis of rotation, the axis of rotation forming a non-zero angle with a principal lengthwise axis of the grasping element.

38. The device according to claim 37, wherein said angle is about 45°.

39. The device according to claim 37, wherein the grasping element has an inclined surface relative to the principal lengthwise axis, and against which a counterpart surface of the two arms bears, the axis of rotation being orthogonal to said inclined surface.

40. The device according to claim 39, wherein the two arms extend in a plane orthogonal to the counterpart surface.

41. The device according to claim 39, further comprising at least one projection on at least one of the surfaces at the grasping element and the two arms, said projection enabling an immobilization of the two arms in a predefined angular position relative to the grasping element.

42. The device according to claim 37, wherein at least one of the two arms and the grasping element incorporates a pivot engaged in a seating to form the axis of rotation.

43. The device according to claim 42, wherein the pivot includes a resilient indentation capable of snapping into the seating.

44. The device according to claim 37, wherein the two arms and the grasping element cooperate so as to enable an immobilization of the two arms in at least one predefined position relative to the grasping element.

45. The device according to claim 37, wherein the two arms and the grasping element cooperate so as to enable an immobilization of the two arms in at least two predefined positions.

46. The device according to claim 45, wherein in a first position, the two arms extend in a plane parallel to the principal lengthwise axis of the grasping element.

47. The device according to claim 46, wherein in a second position, the two arms extend in a plane giving a non-zero angle with the principal lengthwise axis of the grasping element.

48. A device for applying a product to a surface comprising:

a grasping element;

two arms mounted on the grasping element via a junction;

an applicator which is coupled to both of the two arms and which extends between the two arms;

a reservoir capable of charging the applicator with the product, wherein the grasping element connects to the reservoir in a position preventing the applicator from being charged when the applicator is applied against the surface; and a cap capable of being held on the grasping element with the applicator concealed in the cap.

49. The device of claim 48, wherein said two arms are concealed by said cap when the cap is held on the grasping element.

50. The device according to claim 48, wherein the reservoir is associated with the cap.

51. A device for applying a product to a surface comprising:

a grasping element;

two arms mounted on the grasping element via a junction;

an applicator between the two arms; and a reservoir capable of charging the applicator with the product;

wherein the grasping element connects to the reservoir in a position preventing the applicator from being charged when the applicator is applied against the surface;

the device further comprising a pad impregnated with the product; and wherein said pad is made of open-cell foam.

52. A system for applying a cosmetic product, comprising:

a grasping element having a longitudinal axis and an end surface at an end, said end surface having a tangent making an angle with said longitudinal axis other than 90°;

an applicator device including two arms connected to an applicator, said two arms being linked to each other via a connection portion detachably connected to said end of said grasping element, said connection portion having a connection surface corresponding to said end surface of said grasping element, and a reservoir containing a cosmetic product, wherein said reservoir is detachably mounted to said grasping element, wherein said applicator device is pivotable with respect to said grasping element.

53. The system of claim 52, wherein said end surface and said connection surface are flat.

54. The system of claim 52, wherein said two arms extend in one plane.

55. The system of claim 52, wherein said two arms are asymmetric with respect to said pivot portion.

56. The system of claim 52, wherein said two arms have different lengths.

57. The system of claim 52, wherein said two arms are flexible.

58. The system of claim 52, wherein said applicator is a filament.

59. The system of claim 52, wherein said applicator is partially elastically deformable.

60. The system of claim 52, further including a cap detachably mountable to said grasping element.

* * * * *